United States Patent [19]

Sato

[11] 4,257,327

[45] Mar. 24, 1981

[54] LABEL STRIP INSERTING DEVICE

[75] Inventor: Yo Sato, Tokyo, Japan

[73] Assignee: Kabushiki Kaisha Sato Kenkyusho, Japan

[21] Appl. No.: 32,377

[22] Filed: Apr. 23, 1979

[30] Foreign Application Priority Data

Apr. 27, 1978 [JP] Japan ..... 53/55274[U]

[51] Int. Cl.[3] ..... B41K 5/00

[52] U.S. Cl. ..... 101/288; 226/89; 400/600.1

[58] Field of Search ..... 101/288, 291, 292; 226/89, 90; 400/600, 600.1–600.4

[56] References Cited

U.S. PATENT DOCUMENTS

| | | | |
|---|---|---|---|
| 4,075,944 | 2/1978 | Conley | 101/288 |
| 4,176,603 | 12/1979 | Sato | 101/288 |

FOREIGN PATENT DOCUMENTS

| | | | |
|---|---|---|---|
| 2339062 | 4/1974 | Fed. Rep. of Germany | 101/288 |
| 2717272 | 10/1977 | Fed. Rep. of Germany | 101/288 |

*Primary Examiner*—William Pieprz

*Attorney, Agent, or Firm*—Ostrolenk, Faber, Gerb & Soffen

[57] ABSTRACT

The disclosure concerns a label strip inserting device for use in a label printing machine of the type in which a tape-like label strip is carried between a label feed wheel and a label depressing member. The label strip inserting device comprises a platen, which is pivotally secured to the machine body of the label printing machine. An actuating member is interlocked with the platen and is pivoted thereby. A label depressing member is interlocked with the actuating member and it has a label depressing surface to drive the label strip toward the outer surface of the label feed wheel. There are links, which are interlocked with both the platen and the label depressing member. The label inserting device is constructed so that, when a tape-like label strip is to be inserted into the machine body, the platen may be turned to a full open position to separate the label depressing member from the surface of the label feed wheel, thereby forming a large guide passage for insertion of the label strip.

7 Claims, 3 Drawing Figures

LABEL STRIP INSERTING DEVICE

BACKGROUND OF THE INVENTION

1. Field of the Invention

The present invention relates to an improved label strip inserting device for a portable label printing machine. More particularly, the invention relates to a label strip inserting device for use in the insertion of a tape-like label strip into a portable label printing machine of the type which is operated by squeezing a hand grip and a hand lever together and releasing them. The label which is thereby printed is applied to an article by pressing the label printing section of the machine to the surface of the article and squeezing the hand grip and hand lever.

2. Description of the Prior Art

In a conventional label strip inserting device of a label printing machine, a label strip is inserted into the label printing machine by opening a large space for the label strip to pass between a label guide member, on one hand, and a platen and a feed wheel, on the other hand. The feed wheel has feed projections for label transferring. The label guide member is initially in contact with both the platen and the feed wheel. The guide member is separated from the platen and the feed wheel by opening a bottom cover on the labeler and lowering the platen which is connected to the cover. This creates that large space needed for insertion of a label strip. However, when the free or leading end of the label strip has been erroneously bent or folded, the inserted label strip may pass to the front portion of the machine at the printing head or to the rear portion of the machine at the rear side of the feed wheel, and reliable label strip insertion cannot always be expected.

Furthermore, an attempt to insert a label strip when the passage between the guide and the platen is closed may lead to misdirection of the end of the label strip, a result which prevents printing.

In order to avoid the occurrence of the above-mentioned error in label insertion, the label printing machine may be made such that the label strip cannot be inserted into the machine body when the platen is in the closed position.

This invention is related to that shown and described in my application Ser. No. 837,193 filed Sept. 28, 1977.

SUMMARY OF THE INVENTION

It is the principal object of the present invention to provide an improved label strip inserting device for use in a portable label printing machine.

Another object of the present invention is to provide such an inserting device that is free from the disadvantages of conventional inserting devices.

A further object of the present invention is to provide such a label strip inserting device in which smooth and reliable label strip insertion can be attained by the provision of a large label passage.

Still a further object of the present invention is to provide such a label strip inserting device, wherein the aforementioned label insertion error can be detected by the operator at the time of attempted insertion.

A portable label printing machine which is provided with the label strip inserting device of the present invention includes a label strip feed wheel that is pivotally secured to the frame of the label printing machine. The feed wheel transfers both the label strip and the underlying backing paper that is peeled from the label strip and is folded backward around the underside of the platen.

In accordance with the present invention, the label strip inserting device comprises a platen which is pivotally secured to the machine body of the label printing machine, an actuating member which is interlocked with the platen, a label depressing member which is interlocked with the actuating member and which has a label depressing surface to press the label strip toward the outer surface of the label feed wheel, and links which are interlocked with both the platen and the label depressing member. When a tape-like label strip is inserted into the machine body, the platen is rotated open, out from the underside of the body in order to separate the label depressing member from the surface of the label feed wheel, thereby forming a large guide passage for inserting the label strip. The motion of the platen moves both the actuating member, which in turn moves the depressing member, and moves the links, which also moves the depressing member, and the combined motion moves the depressing member a relatively larger distance off the feed wheel.

In another aspect of the present invention, the actuating member of the label strip inserting device is provided with label stoppers which obstruct and prevent erroneous insertion of the label strip when the label depressing member has not been separated from the surface of the label feed wheel.

Further, the above-mentioned members of the label strip inserting device such as the platen, the actuating member, the label depressing member and the links are interconnected for operation by the combination of pins and slots or pin holes.

BRIEF DESCRIPTION OF THE DRAWINGS

Other objects and features of the present invention will become apparent from the following description taken in connection with the accompanying drawings, in which.

DESCRIPTION OF THE PREFERRED EMBODIMENT

Figure 1:
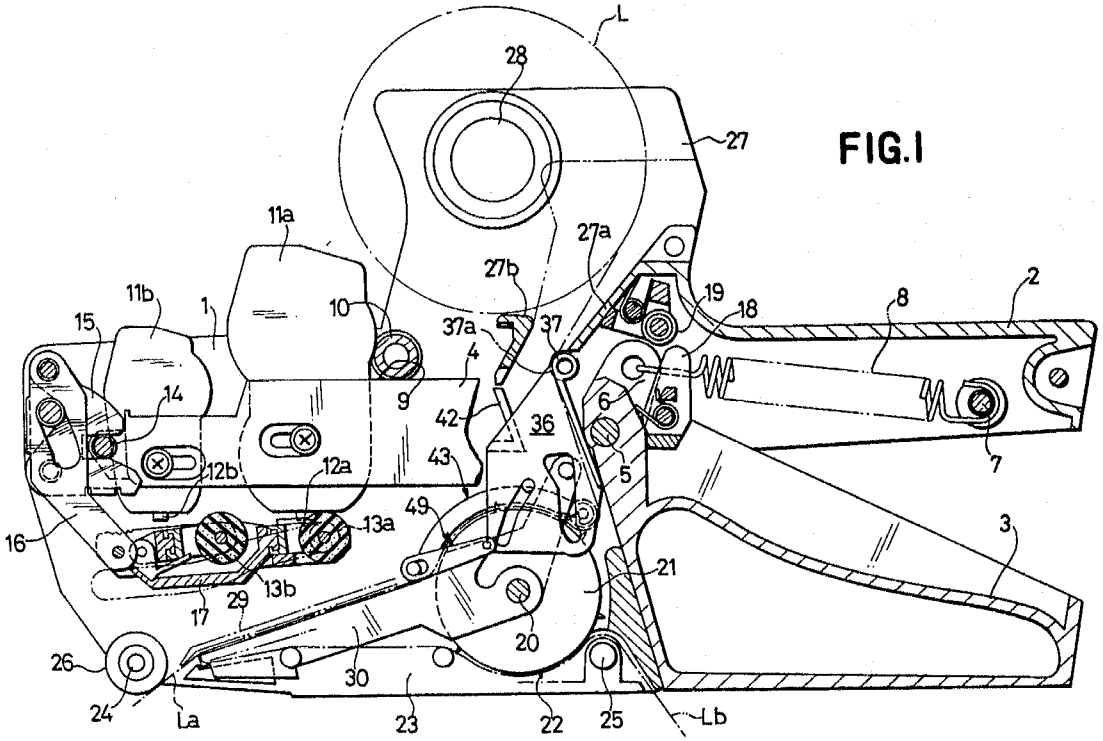
FIG. 1 is a view partly in cross-section and partly in side elevation of a label printing machine which is provided with the label strip inserting device of the present invention; for clarity in observing the operating parts, the side of the machine frame from which the view is taken is removed.

Referring to FIG. 1, the portable label printing machine having an inserting device according to the invention will first be described.

A hand grip 2 extends from the rear of the portable label printing machine, extending out from its location between the pair of opposed side frames 1. There is a hand lever 3, which is in opposed relation to the hand grip 2. The hand lever 3 is pivotally secured to a pivot shaft 5 and that shaft is fixedly located between the machine side frames 1. Printing lever 4 extends forward (to the left) of the hand lever 3. Lever 4 carries printing heads 11*a* and 11*b* on its front end portion. The hand lever 3 is integrally provided with a spring holding member 6, adjacent the aforementioned pivot shaft 5. A return spring 8 is stretched between the spring holding member 6 and a spring pin 7 that is formed in the hand grip 2. Return spring 8 always urges the above-mentioned printing heads 11*a* and 11*b* upwardly (in a clockwise direction), thereby pressing the top surface 9 of the printing lever 4 against the stop 10 which extends from at least one of the side frames 1, thereby determining the stationary or at rest position of the label printing machine.

The printing heads 11*a* and 11*b* are provided with type selecting mechanisms to select desired printing types 12*a* and 12*b* to be used for printing and, in operation, the selected types 12*a* and 12*b* are brought into opposed relation to the platen 30 as described later.

The inking rollers 13*a*, 13*b* which may, for example, be adapted to transmit ink of two color are carried by an inking roller holder 17 and are rolled over the faces of the types 12*a* and 12*b* to apply ink to the types. The types 12*a* and 12*b* have different color inks applied to them, respectively, by means of both the link mechanism comprised of an actuating member 14, an actuating cam 15 and a link frame 16, and an ink roller guiding means.

Further, in the device of the present invention, constant pressure printing can be attained by squeezing the hand lever 3 to bring the printing heads 11*a* and 11*b* into contact with the platen 30. For such purpose the device is provided with a constant pressure printing mechanism between the hand lever 3 and the machine frame 1, which mechanism comprises a pushing member 18 and a pressure receiving member 19.

A rolled tape-like label strip L is supported by the label strip holding piece 28 of a label holder 27. The label strip L is brought into engagement with the feed pins 22 which are disposed at regular intervals on the peripheral surface of the feed wheel 21 that is rotatably held by the main shaft 20. Release of the hand lever 3 after each squeezing operation thereof causes the feed wheel 21 to turn intermittently through any known drive connection between the hand lever 3 and the wheel 21. The label strip L is thereby advanced onto the upper surface of the platen 30.

The tape-like label strip L is comprised of a tape-like backing paper Lb and a series of adjacent label pieces La which are disposed on the backing paper Lb which are separated by precut lines. The backing paper Lb is coated with a releasing agent. The rear side of each label piece La is coated with an adhesive agent by means of which the series of label pieces La are temporarily stuck to the coated surface of the backing paper Lb. Feed perforations are formed in both the label pieces La and backing paper Lb at the intervals corresponding to the pitch of the label pieces La. The feed perforations are brought into engagement with the feed pins 22 of the feed wheel 21.

The label strip inserting device of the present invention is formed about the feed wheel 21 in order to enable insertion of the label strip L into the machine body and to bring it into engagement with the feed wheel 21.

Figure 2:
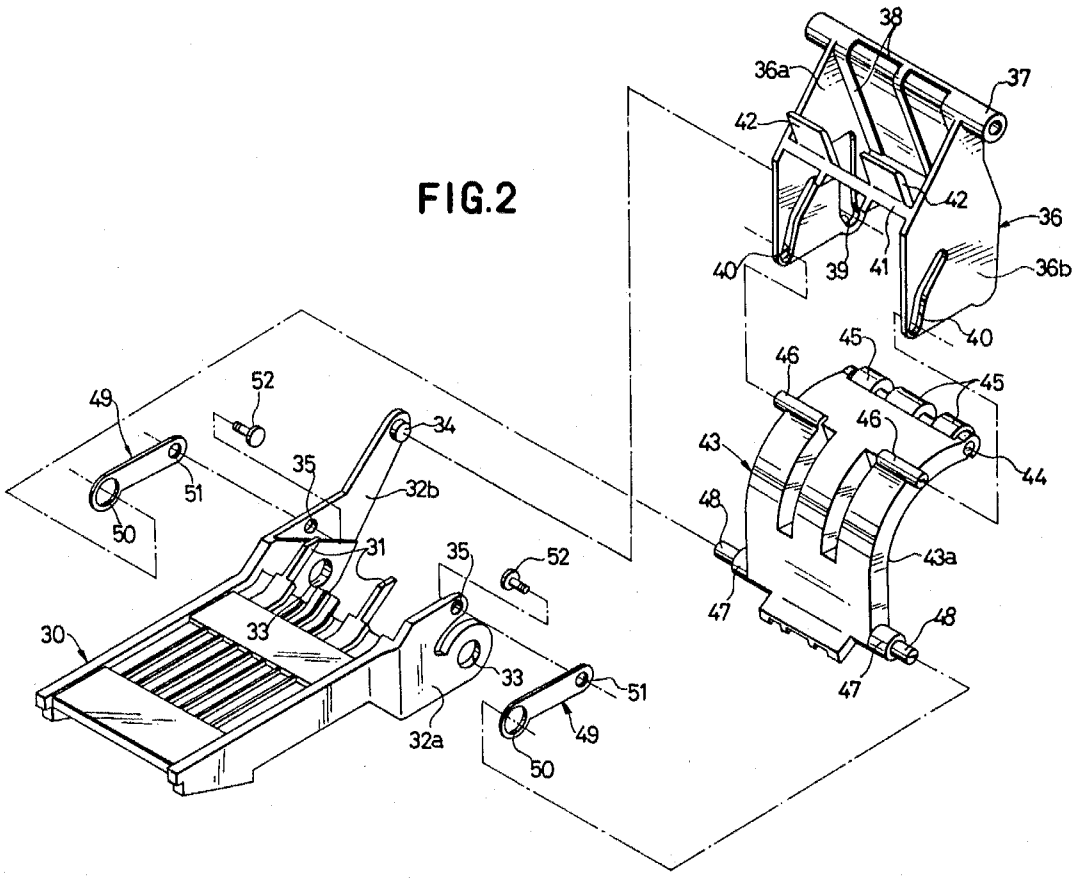
FIG. 2 is an exploded perspective view of the principal parts of the label strip inserting device.
Figure 3:
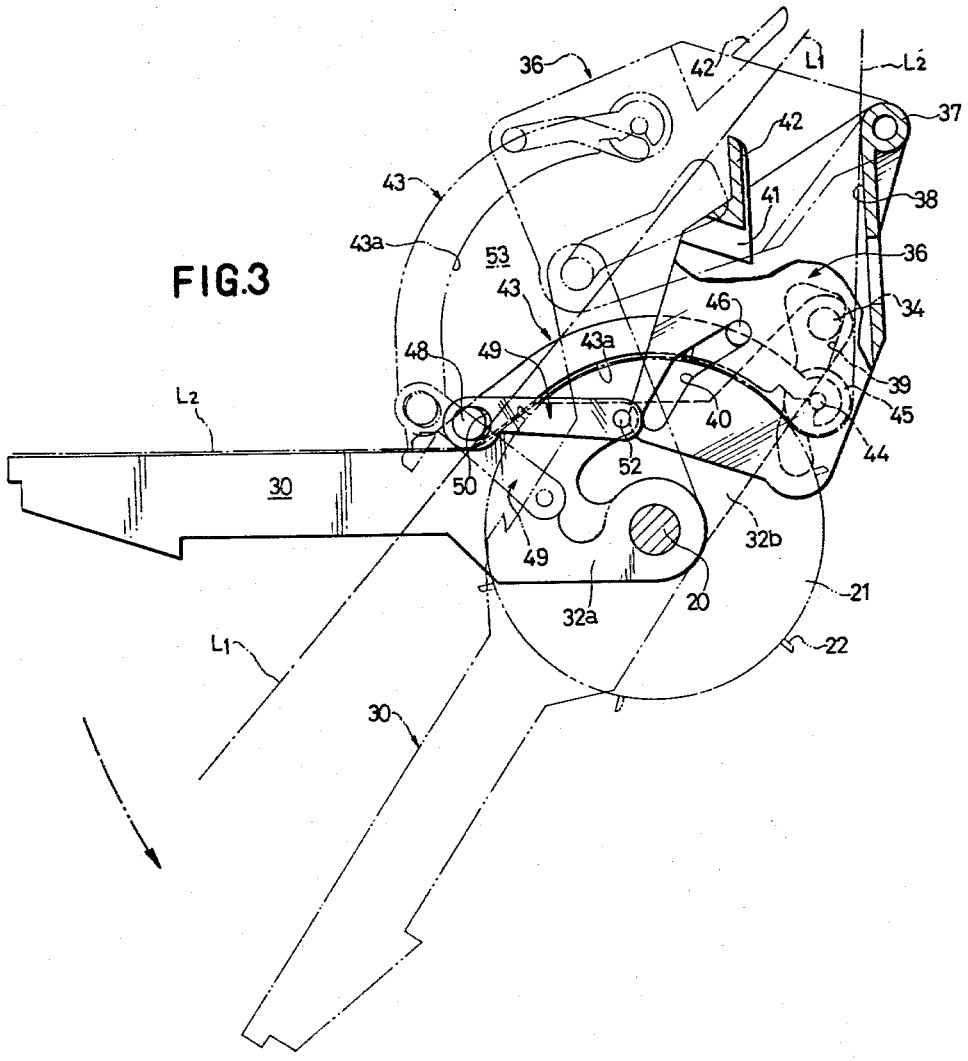
FIG. 3 is a side view of the principal parts of the structure illustrating the operation of the device.

As shown in FIGS. 2 and 3, the label strip inserting device of the present invention is comprised, principally, of the platen 30 which can be turned relative to the machine frames 1, a movable actuating member 36 which is pivotally secured to the machine frames 1 and is interlocked with the platen 30, a label depressing member 43 which is interlocked with the actuating member 36, and a pair of links 49 which are interlocked with both the label depressing member 43 and the platen 30. Any or all of these members may be made of synthetic plastics.

The platen 30 is integrally provided with label guiding pieces 31 at it rear, the upstream end of the platen, a short arm 32*a* at one side of the platen at the rear and a long arm 32*b* at the other side at the rear. Aligned shaft receiving holes 33 are defined in the arms 32*a* and 32*b*, and holes 33 movably engage the main shaft 20 of the label feed wheel 21. An inwardly oriented engaging pin 34 is formed at the tip end of the long arm 32*b*.

The actuating member comprises a frame body. The upward base end 37 of the member 36 is pivotally fitted into the engaging grooves 37*a* (see FIG. 1), which are formed in the machine frames 1. Label guiding portions 38 having upper convexly arcuately curved ends extend downwardly from the base end 37. The actuating member 36 has a pair of opposed side walls 36*a* and 36*b*. The side walls 36*a* on one side has a vertically elongated slot 39, which receives therein the engaging pin 34 of the platen 30. Additional rearwardly tilted, bent, elongated slots 40 are formed in side walls 36*a* and 36*b* to receive the engaging pins 46 of a label depressing member 43, described below. A supporting bar 41 is laterally disposed between the side walls 36*a* and 36*b*. The supporting bar 41 is integrally provided with L-shaped label stoppers 42.

The label depressing member 43 has the cross-sectional shape of a arcuate plate. The concave inside of the arcuate curve defines a depressing surface 43*a* which pushes down the tape-like label strip L that is fitted over the label feed wheel 21. Engaging pins 46 are formed at the upper concave side of the depressing member 43. Pins 46 are fitted into the slots 40 of the actuating member 36. The upper rearward end portion of the label depressing member 43 supports a roller shaft 44, and a plurality of label guide rollers 45 are rotatably supported on the roller shaft 44. The base ends 47 on both sides of the lower part of the label depressing member 43 are integrally provided with outwardly projecting supporting shafts 48.

The pair of links 49 each have small slots 50 extending through the links off toward one side thereof at the ends thereof. Supporting shafts 48 of the label depressing member 43 are movably secured in slots 50. Connecting holes 51 are formed in the other rearward ends of the links 49, in order to connect the links to the platen 30. These connecting holes 51 are aligned with the corresponding holes 35 that are formed in both of the arms 32*a* and 32*b* of the platen 30 and the platen and the links 49 are attached by the connecting screws 52.

The label inserting operation and the operation of the device of the present invention are now described.

In FIG. 1, the locking device 25 for the bottom cover 23 which is disposed in the lower part of the inserting device, is unlocked. The bottom cover 23 is then turned open in a clockwise direction, about the fulcrum of the shaft 24.

Before the opening of the bottom cover 23, the platen 30 is held between the upper part of the bottom cover 23 and the label depressing portion 29 which is attached to the inside wall of the machine frame 1 above the platen. When the bottom cover 23 is opened as described above, the platen 30 is turned from the position shown in solid lines to that shown in two-dot chain lines in FIG. 3, i.e. the platen 30 is turned counterclockwise about the fulcrum of the main shaft 20. This moves the interlocked members, i.e. the actuating member 36, the label depressing member 43 and the pair of links 49 into the respective positions indicated by the two-dot chain lines.

More particularly, the engaging pin 34 of the platen 30 that is fitted into the slot 39 of the actuating member 36 is moved up counterclockwise, and the actuating member 36 is thereby turned clockwise about the fulcrum defined by its upper base end 37. With the turning of the actuating member 36, the engaging pins 46 of the label depressing member 43 are moved up and counterclockwise, since the pins 46 are fitted into the slots 40 of the actuating member 36. The depressing surface 43*a* of the label depressing member 43 is moved upward apart from the peripheral surface of the label feed wheel 21. In this movement of the label depressing member 43, since the links 49 are attached to both the supporting shafts 48 at the bottom of the member 43 and to the connecting screws 52 of the platen 30, the counterclockwise motion of the screws 52 moves the links 49 even further to the left and through the shafts 48 moves the label depressing member 43 still further apart from the label feed wheel 21 to form a large label passage 53 between both the members.

The tape-like label strip $L_1$ is thereafter passed through the space between the label guide pieces 27*a* and 27*b* (see FIG. 1) and then, as shown in FIG. 3, it is passed through the space between the label guiding portion 38 and the label stopper 42 of the actuating member 36 and then through the label passage 53 which is formed between the label feed wheel 21 and the label depressing member 43, and the free end of the inserted label strip $L_1$ is hung down.

As the tape-like label strip $L_1$ has been inserted, the platen 30 is turned clockwise and the interlocked label depressing member 43 is thereupon pushed toward the label feed wheel 21, in which the precut lines of the label strip are set to the feed pins 22 of the feed wheel 21, thereby completing the label insertion.

After the tape-like label strip $L_2$ has been inserted, the tape-like backing paper Lb of the label strip $L_2$ is separated from the series of label pieces La on it. The backing paper Lb is downwardly and rearwardly folded in front of the front end of the platen 30 and is led to the rear side of the platen 30. Further, the backing paper Lb is again brought into engagement with the label feed wheel 21 and is further guided to and out the rear part of the machine body at the bottom.

As shown in FIG. 1, the bottom cover 23 is then closed to support the platen 30 between the bottom cover 23 and the label depressing portion 29.

If a tape-like label strip L is inserted into the machine body without first pulling down the platen 30, that is, while the label depressing member 43 is still pressed to the label feed wheel 21, the forward end of the inserted label strip is stopped by the label stoppers 42 which are formed on the actuating member 36. Therefore, the insertion of the label strip can be obstructed so that erroneous insertion of the label strip can be prevented.

As described above, the label inserting device of the present invention is comprised of the combination of the actuating member which is interlocked with the turning of the platen, the label depressing member which pushes the tape-like label strip toward the label feed wheel, and the links which are interlocked with both the label depressing member and the platen over which the tape-like label strip is imprinted. When a label strip is inserted into the label printing machine, the label depressing member can be widely separated from the label feed wheel by turning open the platen, and this separation is made more effective by the provision of the links. Accordingly, the label passage between the feed wheel and the label depressing member is quite large so that the tape-like label strip can easily be inserted into the machine body even when each label piece is large or the pitch of the feed pins on the feed wheel is large.

Furthermore, the above-described actuating member is provided with label stoppers which are disposed across the label passage between the label guiding pieces. Therefore, label insertion cannot be done when the label depressing member is in engagement with the label feed wheel. Accordingly, erroneous label insertion can be prevented.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A label strip inserting device for a label printing machine for inserting a tape-like label strip:

said label printing machine comprising: a machine frame;

a platen pivotally secured to said machine frame; a printing head in opposition to said platen; means for moving said printing head and said platen together and apart to print a label on said platen;

a label strip feed wheel for feeding the label strip toward said platen;

said label strip inserting device comprising:

said platen;

an actuating member which has a first portion farther from said platen and that is pivotally connected to said machine frame and has a second portion pivotally connected to said platen;

a label depressing member which is pivotally connected to said actuating member remote from said first portion; said depressing member having a label depressing surface opposed to said feed wheel to press said tape-like label strip toward said label feed wheel; and a link which is connected with said platen remote from the pivot connection of said platen to said machine frame; said link also being connected to said label depressing member remote from the connection between said depressing member and said actuating member, said platen being pivotable in a direction which moves both said actuating member and said link to separate said label depressing member, at the connection of said label depressing member with said actuating member and with said link, from said label feed wheel to form a label guide passage for inserting said label strip; said label guide passage when opened comprises a said label depressing surface of said label depressing member and said feed wheel, and further downstream in the path of insertion of labels, said platen.

2. The label strip inserting device of claim 1, wherein said actuating member is provided with label stoppers that extend into said label passage, such that the insertion of a label strip is prevented when said label depressing member has been moved toward said label feed wheel and permit entry of end of a label strip when said platen and label depressing member are separated to form said entry passage for the end of the tape-like strip.

3. The label strip inserting device of either of claims 1 or 2, wherein said link is pivotally connected to both of said depressing member and said platen.

4. The label strip inserting device of claim 1, wherein said label depressing member is provided with guide rollers at the upstream end thereof with respect to motion of label strip which guide the label strip.

5. The label strip inserting device of claim 3, wherein the connections between said platen, said actuating member said label depressing member and said link comprises a respective slot in one of each of any two of said connected elements and a projection into the respective said slot on the other of any two of said connected elements.

6. The label strip inserting device of claim 3, wherein the said connection of said link to said platen is located so that it is opposed to said depressing surface and spaced from said depressing means, and the said connection of said link to said depressing member is at said depressing member, and the pivoting of said platen to raise said depressing surface off said feed wheel is in a direction that moves the said link radially outwardly of said feed wheel, thereby to raise said depressing surface off said feed wheel as said platen pivots in said direction.

7. A label strip inserting device for a label printing machine for inserting a tape-like label strip:

said label printing machine comprising: a machine frame; a platen pivotally secured to said machine frame; a printing head in opposition to said platen; means for moving said printing head and said platen together and apart to print a label on said platen;

a label strip feed wheel for feeding the label strip toward said platen;

said label strip inserting device comprising:

said platen which is movable to a first open position away from the position at which a label may be printed on said platen;

an actuating member which is interlocked with said platen, such that motion of said platen to said first open position moves said actuating member to a respective second open position;

a label depressing member which is not directly connected to said frame and which is at a first portion thereof interlocked with said actuating member and having a label depressing surface which is opposed to said feed wheel, to press said tape-like label strip toward said feed wheel; said depressing member being interlocked to said actuating member at a location spaced from the said interlocking of said platen to said actuating member, and such that motion of said actuating member to said second open position thereof moves said depressing member to a respective third open position thereof spaced off said label feed wheel, and movement of said platen back again from said first open position thereof moves said depressing member surface toward said label feed wheel;

a link interlocking said platen and said depressing member at a second portion thereof spaced from said first portion, and said link being movable to move said depressing member to said third open position as said platen moves to said first open position;

whereby motion of said platen to said first open position moves said actuating member and said link to move said first and second portions of said depressing member to said third open position.

* * * * *